United States Patent [19]

Jubb

[11] Patent Number: 4,741,673

[45] Date of Patent: May 3, 1988

[54] APPARATUS FOR AND A METHOD OF TRANSFERRING LIQUID

[75] Inventor: Albert Jubb, Kenilworth, United Kingdom

[73] Assignee: Cosworth Engineering Limited, Northampton, United Kingdom

[21] Appl. No.: 75,286

[22] Filed: Jul. 20, 1987

Related U.S. Application Data

[63] Continuation of Ser. No. 756,980, Jul. 8, 1985, abandoned.

[30] Foreign Application Priority Data

Nov. 11, 1983 [GB] United Kingdom ..... 8330107
Nov. 12, 1984 [EP] European Pat. Off. ..... 84307796.7

[51] Int. Cl.[4] ..... F04B 9/10
[52] U.S. Cl. ..... 417/53; 417/349; 417/392; 417/394
[58] Field of Search ..... 417/392, 349, 377, 394, 417/374, 53; 91/165, 464

[56] References Cited

U.S. PATENT DOCUMENTS 3,749,526 7/1973 Ferrentino ..... 417/394

FOREIGN PATENT DOCUMENTS 2027226 2/1980 United Kingdom .
2088968 6/1982 United Kingdom ..... 417/377

*Primary Examiner*—Leonard E. Smith

*Attorney, Agent, or Firm*—Parmelee, Miller, Welsh & Kratz

[57] ABSTRACT

An apparatus for transferring liquid between regions of a first and a second pressure comprising:

a vessel, a dividing member in the vessel, the vessel and the dividing member being relatively movable to divide the vessel into separate variable volume chambers, a first pair of valves, one of which controls passage of liquid between a first of said chambers and said region of a first pressure, the other of which controls passage of liquid between a second of said chambers and said region of a first pressure, a second pair of valves, one of which controls passage of liquid between said first chamber and said region of a second pressure, the other of which controls passage of liquid between said second chamber and said region of a second pressure, operating means repeatedly to perform the following cycle of operations;

close the valves of one of said pairs and open the valves of the other of said pairs, then move the dividing member to cause the volume of said first chamber to increase and the volume of said second chamber to decrease, then close the valves of the other of said pairs and open the valves of said one pair, and then move the dividing member to cause the volume of said first chamber to decrease and the volume of said second chamber to increase.

14 Claims, 8 Drawing Sheets

APPARATUS FOR AND A METHOD OF TRANSFERRING LIQUID

This is a continuation of co-pending application Ser. No. 756,980 filed on July 8, 1985, now abandoned.

BACKGROUND OF THE INVENTION

Field of the Invention

This invention relates to an apparatus for and a method of, transferring liquid between regions of a first and a second pressure.

SUMMARY OF THE INVENTION

An object of the invention is to provide a new and improved apparatus for, and a method of, transferring liquid between regions of a first and a second pressure with minimum energy loss.

According to one aspect of the invention, we provide an apparatus for transferring liquid between regions of a first and a second pressure comprising:

a vessel, a dividing member in the vessel, the vessel and the dividing member being relatively movable to divide the vessel into separate variable volume chambers, a first pair of valves, one of which controls passage of liquid between a first of said chambers and said region of a first pressure, the other of which controls passage of liquid between a second of said chambers and said region of a first pressure, a second pair of valves, one of which controls passage of liquid between said first chamber and said region of a second pressure, the other of which controls passage of liquid between said second chamber and said region of a second pressure, operating means repeatedly to perform the following cycle of operations;

close the valves of one of said pairs and open the valves of the other of said pairs, then move the dividing member to cause the volume of said first chamber to increase and the volume of said second chamber to decrease, then close the valves of the other of said pairs and open the valves of said one pair, and then move the dividing member to cause the volume of said first chamber to decrease and the volume of said second chamber to increase.

Thus, in use, assuming for purposes of explanation that it is the valves of said second pair of valves which are first closed, the following cycle of operations is repeatedly performed:

On movement of the dividing member, after closing of said second pair of valves, to cause the volume of the first chamber to increase, liquid enters into said first chamber from said region of first pressure and liquid which has previously entered said second chamber from said second pressure region is subjected to said first pressure within said second chamber and discharged to said region of first pressure; on movement of the dividing member to cause the volume of the second chamber to increase, liquid which has previously entered said first chamber from said first pressure region is subjected to said second pressure in said second chamber and discharged therefrom into said region of second pressure, and liquid enters into said second chamber from said region of second pressure.

The dividing member may comprise a flexible diaphragm or a piston reciprocable in the vessel and in sealing engagement with the walls thereof.

Alternatively the dividing member may comprise a deformable member defining an enclosed volume within the vessel.

The dividing member may be caused to move to vary the volume of said chambers by applying a pressure difference in the liquid on opposite sides of the dividing member, for example by means of a pump.

The liquid drawn into and displaced from the first chamber is not mixed with the liquid drawn into and displaced from the second chamber and therefore the two liquids may be completely different.

The apparatus and method of the present invention are of most benefit when the difference in pressure between the first and second regions is large, for example up to 300 m head of water and with large volume flows.

One application of the invention is to supply water for cooling purposes from a source such as a river or ocean to a plant situated high above the source, where the water once having been used, for example for cooling, is returned to the source. Water enters the first chamber from the source at the level or substantially at the level thereof and the pressure of the water is raised in the first chamber and is then delivered through a conduit to the plant where the water performs its cooling function and then returns down another conduit to the second chamber at or substantially at the level of the source where its pressure is lowered and is then discharged.

Alternatively, water at depth in a lake or ocean can be transferred by the present invention from an ambient pressure of, for example 1000 p.s.i. to, for example 30 p.s.i. and used as desired, for example for cooling, gas absorption, gas desorption, and then returned to be re-pressurised to the original pressure of 1000 p.s.i.

The invention achieves transfer between the regions of first and second pressure with small energy losses. Such losses as do occur, are primarily due to friction in conduits associated with the apparatus and turbulence in valves, plus effects due to compressibility of the liquid with which the invention is used. In the case of water, for example, the latter effect is relatively small and compressibility effects merely require compensating by a small volume high pressure pump to prevent a small net inflow of water from a higher pressure region to a lower pressure region.

The flow limits are set by acceptable pressure drop losses primarily in the valves and in the conduits by the kinetic energies of the moving dividing member and the liquid it displaces. The latter is not a major factor when the dividing member area is relatively large, for example ten times higher than the valve flow area.

If desired, a plurality of vessels may be provided, there being a dividing member in each vessel, each vessel and dividing member therein being relatively movable to divide each vessel into separate variable volume chambers, each vessel having a first pair of valves, one valve of each first pair of valves controlling passage of liquid between a first of said chambers of the associated vessel and said region of the first pressure, the other of each first pair of valves controlling passage of liquid between a second of said chambers of the associated vessel and said region of a first pressure, each vessel also having a second pair of valves, one valve of each second pair of valves controlling passage of liquid between said first chamber of the associated vessel and said region of a second pressure and the other valves of each second pair of valves controlling passage of liquid between said second chamber of the associated vessel and said region of a second pressure, and the said operating means being arranged repeatedly to perform said cycle of operations for each vessel.

The valves of at least some vessel may be moved out of phase with the valves of at least some other vessels.

Where two vessesl are provided then the first pair of valves of one vessel are arranged to be open when the first pair of valves of the other vessel are closed and the second pair of valves of the one vessel are closed when the second pair of valves of the other vessel are open and vice versa. As a result the two vessels substantially work out of phase and so give a substantially continuous flow.

Three vessels may also be used in appropriate sequence so that when one is operating with the valves to the first pressure region open, a second is operating with the valves to the second pressure region open, whilst a third is in a "closing valves and opening valves" phase. If desired more than three units can be arranged to increase the flow from a given size of vessel to avoid a multiplication of vessels size to cover a range of different flow rates.

It is, of course, essential that both valves of each pair of valves are fully closed before the other pair of valves can be opened. In the case of a submarine application, with the system operated at depth, failure to observe the above valve opening and closing regime would lead to flooding of equipment in which the apparatus is used. Valves are therefore operated by a system as proof as possible against failure to mishandling or mechanical failure such as resulting from ingested detritus.

To allow for compressibility of liquid, for example about a half percent compressibility in the case of water, at a depth of about 1000 meters, pump means are provided appropriately to compensate for differential flows resulting therefrom by pumping the excess liquid direct from the region of low pressure to that of high pressure. If such means were not provided, then when opening the valves to a region of lower pressure after closure of the valves to a region of higher pressure, a high pressure flow of liquid would pass through the valves until the pressure in the chambers falls as a result of the appropriate volume of liquid, half percent in the case mentioned above, has passed to the lower pressure region. As a result, a greater volume of liquid would be transferred from the higher pressure side to the lower pressure side than vice versa. Conversely, when valves to the higher pressure region are opened after closure of the valves to the lower pressure side, there would be an inflow of the appropriate volume, half percent in the case mentioned above, and a resultant smaller volume of water would be transferred from the lower pressure region to the higher pressure region than vice versa. Thus besides loss of energy, proportional to the square of the pressure, there would be a net change in the volume of liquid being transferred which would be appropriately compensated by the pump means.

In addition to effects arising from the compressibility of the liquids, the volume of the chambers can also vary if the pressure differential between the first and second pressure regions is great. These effects are usually small compared with that arising from liquid compressibility, for example 10% to 20% of the volume change arising from water compressibility, although the effects are additive.

If any of the valves do not seal properly when moved to an open or closed position, it is desirable and indeed in certain applications, such as a submarine vessel where an incontrollable negative buoyancy condition can be created due to excess water inleak, absolutely essential that the operation of the system be stopped and the system be sealed from both the first pressure and second pressure regions.

This may be achieved by providing a small "pilot" valve providing communication between each chamber and the regions of high and low pressure. As a result, the extra volume of liquid arising from compression effects present after the valves to the high pressure region are closed, can be allowed to leak out to the lower pressure region. If, however, either of the valves to the higher pressure region are not completely shut, continued flow of liquid will arise through the small "pilot" valve and the pressure in the chamber will not fall to the lower pressure level. A pressure difference signal across the pilot valve generated, for example, by a diaphragm operating an electrical system may be used to indicate that one of the valves to the higher pressure region is not sealing, and a signal provided to prevent further operation of the system.

The amount of valve leakage permitted can be determined by controlling the rate of flow through the pilot valve.

Alternatively, where the chambers are full of liquid at lower pressure and the valves to the lower pressure region are closed, opening a pilot valve between the chambers and the higher pressure region initially causes an inflow of liquid due to compressibility which would then stop. If however one of the valves to the lower pressure region is not completely sealed, the inflow will continue and there will be a continuous pressure drop across the pilot valve which may again be monitored.

The apparatus may be operated at any desired flow rate up to the pressure drop available from the pumps which provide the pressure differential to move the dividing member.

The valves to the first and second pressure regions may be operated at fixed frequency so that the dividing member stroke at low flow rates would be small compared with the maximum stroke. In addition, since the effects due to liquid compression occurs on every cycle, it is desirable to make the valve operation slow at low flow rates to reduce energy losses due to compressibility.

In any situation where it is inconvenient to provide a pump on the higher pressure side to displace the dividing member, a resilient biasing means such as a spring may be provided to act on the dividing member so that when the valves to the higher pressure region are opened the resilient biasing means biases the dividing member to discharge liquid to the higher pressure region and to draw liquid from the higher pressure region into the other chamber. The pump on the lower pressure side provides a pressure differential which overcomes the effect of the resilient biasing means to cause reverse movement of the dividing means.

The resilient biasing means may be the sole source of movement of the dividing member when the valves to the higher pressure region are open or, if the apparatus is applied to a moving vehicle, the speed of the vehicle in the water could provide some of the desired pressure difference, for example by means of ram scoops or the like.

The rate of movement of the dividing member, and hence the rate of discharge and filling to and from the higher pressure region, is controlled by the means for moving the dividing member. As a result, the time of dividing member travel when the chambers are connected to the region of higher pressure may be short, while at low flow rates, the dividing member travel time could be larger when discharging to or filling from the lower pressure region.

Similarly the speed of operation when the chambers are connected to the lower pressure region is controlled by the pressure difference/flow characteristics of the pump on the lower pressure side, so that flow rates can be controlled by a by-pass on a mechanical pump or a throttle on a centrifugal pump or by other means.

When the dividing member reaches the limit of its travel, the inflow of liquid ceases. In those cases where it is desired to prevent sudden flow stoppage, this can be achieved by starting to close the valves that are open before the dividing member reaches the limit of its travel, so that a reasonably fast reduction of flow can be arranged without liquid hammer.

A signal indicative of the dividing means position adjacent the ends of its travel may be provided by any known means, such as a magnet on the piston in association with a reed switch outside the chamber responding to the magnetic movement, and arranged to signal the closing and opening of the valves.

Where the dividing member is a piston reciprocable in a cylinder, the piston is designed so that it can withstand loads imposed thereon if held at the end of its travel and subjected to the maximum pressure differential between the first and second pressure regions.

The valves may be arranged to be operated by means of a common drive shaft.

The valves connected to each chamber of a vessel may be combined into a single valve assembly having three ports, one port being connected to the chamber, one port being connected to said region of first pressure and one port connected to said region of second pressure, the valve assembly being operable to interconnect the port connected to the chamber to either one of the other two ports. The valve assembly may have an intermediate "all shut off" position.

The valve assemblies connected to the two chambers may be operated by a single mechanism.

The valves may comprise ball type rotating elements with two passages interconnected within the ball, the angular position of the two passages being about 90° in a plane at right angles to the axis of rotation, the ball being mounted in a valve body provided with three ports.

With the ball in a first position, communication is provided between the associated chamber and the region of high pressure. Rotation of the ball from this position through 270° will then cause communication between the associated chamber and the region of low pressure and there will be a substantial angle, approaching 270° where no cross connection occurs.

Each port may comprise a sealing ring, one face of the ring being part spherical and bearing on the rotatable ball, and the sealing ring may have a peripheral part sealed to the valve body with a conformable material such as rubber or by a flexible bellows.

Resilient biasing means, such as a spring, may urge each seal ring against the ball and the effective area of the seal is arranged so that working pressure differences also load the seal ring onto the ball.

To ensure corrosion resistance and minimise risk of detritus affecting the seal between the seal ring and ball, both may be made of hard material such as tungsten carbide.

The edges of the seal ring and the openings of the passages in the ball may be sharp and square so that any detritus encountered, in general, being softer than the material of which the components are made and so will be cut thereby causing no damage and leaving the seal tight.

The pilot valve may conveniently be provided by providing a small groove in the ball which can allow a small leak of liquid across the sealing faces of the ring. However, with this arrangement, the effectiveness of the pilot valve as well as the main valve depends upon the same sealing mechanism, since any failure of the sealing mechanism would affect not only the main valve but also the pilot valve.

Therefore, where a high safety factor is required, it is desirable to provide the pilot valves independently of the ball valves. In this case, the pilot valves may comprise a rotatable shaft with a small transverse bore mounted in a close fitting passage in a valve body and the pilot valves for each chamber may be provided on a common rotatable shaft.

Alternatively the valves may comprise rectilinearly movable type elements comprising a valve body having ports connected to the associated chamber and regions of high and low pressure and a valve member rectilinearly slidable within a bore in the valve body and operable to interconnect ports.

The valves connected to both the chambers of a vessel may be combined into a single valve assembly having two sets of three ports, one port of each set being connected to an associated one of the chambers, a second port of each set being connected to the region of first pressure, the third port of each set being connected to the region of second pressure and the valve member and valve body being relatively movable to interconnect the ports connected to the chambers with either of the other ports of the associated set. Where the apparatus comprises two vessels a said single valve assembly may be provided for each vessel and the valve members of each valve assembly being arranged to move relatively to their assembled valve member out of phase with each other.

According to another aspect of the invention, we provide a method of transferring liquid between regions of first and second pressure comprising the steps of:

isolating first and second variable volume chambers from one of said regions and then placing said chambers in communication with the other of said regions;

causing liquid from said other region to enter into the first variable volume chamber and displacing, from the second variable volume chamber into said other region, liquid which has previously entered the second chamber from said one region;

isolating the chambers from said other region and then placing the chambers in communication with said one region and then displacing, from said first chamber into said one region, liquid which has previously entered said first chamber from said other region and causing liquid from said one region to enter into the second chamber.

Said one of said regions may comprise said region of second pressure which may be a low pressure region and said other of said regions may comprise said region of first pressure which may be a high pressure region.

BRIEF DESCRIPTION OF THE DESCRIPTION

Embodiments of the invention will now be described by way of example, with reference to the accompanying drawings, wherein.

DESCRIPTION OF THE PREFERRED EMBODIMENT

Figure 1:
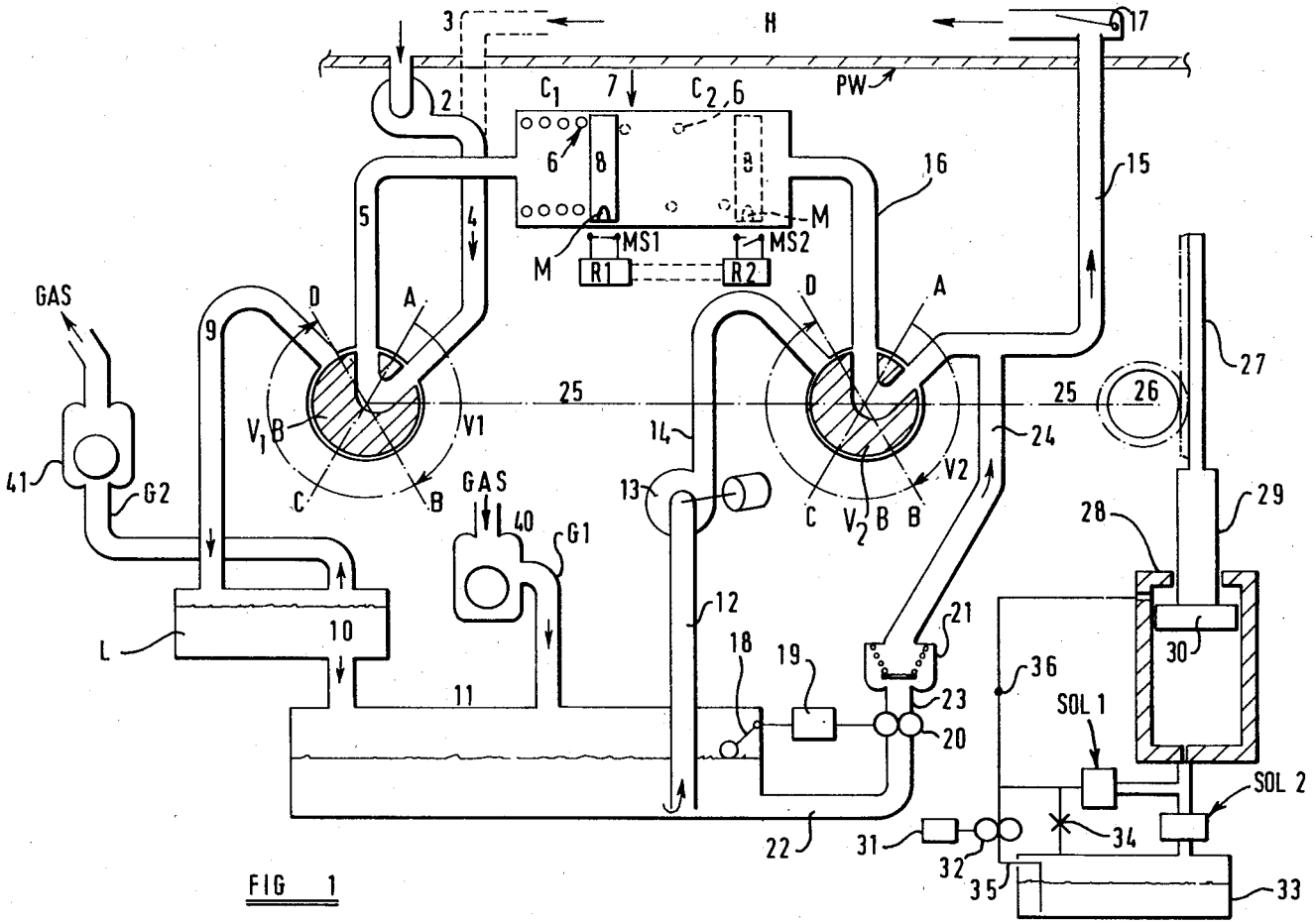
FIG. 1 is a diagrammatic illustration of one embodiment of the invention.

Referring now to FIGS. 1–6, liquid, in the present example water, is to be transferred from a region H at high pressure on one side of a pressure wall PW to a region L of low pressure on the opposite side of the wall PW. In the present example the pressure wall PW comprises part of the pressure hull of a submarine vessel and the region L is a region where a cooling operation is performed by placing the water in heat transfer relationship with an apparatus to be cooled, but if desired the water may be used for any other purpose, such as gas absorption or gas desorption. In the present example, the pressure obtaining in the region L is the same as the pressure obtaining in the whole of the region on the opposite side of the pressure wall PW to the high pressure region H. However, if desired, the pressure in the region L may be different from the pressure externally of the region L as well as, of course, being different from the pressure in the region H. Thus, the apparatus hereinafter described transfers liquid between regions of a first and second pressure, in the present example the first pressure region being a relatively high pressure and the second pressure region being a relatively lower pressure than the pressure in the high pressure region.

Water from the region H is taken in through a conduit 1 by means of a pump 2. Alternatively, if desired, particularly in the case where there is relative movement between the region H and the pressure wall PW, the water can be taken in through a ram intake indicated in dotted outline at 3. The water then passes via a conduit 4 to a ball valve means $V_1$ which is illustrated occupying a position A. The valve means $V_1$ has three ports each with a seal, hereinafter to be described with reference to FIGS. 3–6, in sealing engagement with a ball $V_1B$ which is rotatable by means of a shaft 25 driven by a pinion 26 rotated by a rack 27. A similar valve means $V_2$ is also arranged to have its ball $V_2B$ rotatable by the shaft 25.

Water leaves the valve means $V_1$ via a conduit 5 to a vessel 7 which is divided into first and second chambers by a piston 8 slidably and sealingly mounted in the vessel 7 which thereby provides a cylinder. Alternatively, instead of a slidable piston, the vessel 7 may be divided into first and second chambers by means of some other form of dividing member such as a diaphragm. If desired, the vessel and dividing member may be provided by other means such as a rotary piston and housing arrangement or a vane type device, suitable means being provided to cause relative rotation of the piston/vane and its associated housing.

A coil compression spring 6 is provided to act on the piston 8 to bias it to the right in FIG. 1.

The biasing effect of the spring 6, together with the pressure provided by the pump 2, causes water to enter the first chamber $C_1$ of the vessel 7 and the piston 8 to move from left to right to occupy the dotted line position shown in FIG. 1.

Water in the second chamber $C_2$, i.e. on the right hand side of the piston 8, is displaced by the piston movement through the conduit 16 to valve means $V_2$ which is also in the position indicated at A illustrated in FIG. 1, and thus passes through the valve means $V_2$ and leaves the latter through conduit 15 to enter the high pressure region H through a non-return valve 17.

When the balls $V_1B$ and $V_2B$ of both valve means $V_1$, $V_2$ are rotated through an angle of about 300° to position D (by shaft 25, pinion 26 and rack 27) the conduits 4 and 15 are shut off and the first chamber $C_1$ of the vessel 7 is connected by conduit 5, valve means $V_1$, in position D, and conduit 9 to the low pressure region L, i.e. a process volume 10, where the desired cooling, gas absorption, desorption or other process takes place. Water flows from the process volume 10 to a reservoir 11 from which the water is sucked via a conduit 12 by a pump 13 and is delivered by a conduit 14, valve means $V_2$ in position D, and conduit 16 to the second chamber $C_2$ of the vessel 7.

Flow of liquid along the above described path occurs because of the pressure rise provided by the pump 13 which not only makes up the pressure drops in the valves and conduits, process volume 10 and reservoir 11, but also overcomes the biasing effect of the spring 6 and thus forces the piston 8 from right to left in FIG. 1 and thus displaces water out of the chamber $C_1$, whilst permitting water to enter the chamber $C_2$.

Thus the ports of the valve means $V_1$ connected to conduits 4 and 5 together with the ball $V_1B$ provide one valve of a first pair of valves which controls passage of water between the chamber $C_1$ and the region of high pressure H. The ports of the valve means $V_2$ connected to conduits 15 and 16 together with the ball $V_2B$ provide the other valve of the first pair of valves which controls passage of water between the chamber $C_2$ and the region of high pressure H. The ports of the valve means $V_1$ connected to conduits 5 and 9 together with ball $V_1B$ provide one valve of a second pair of valves which controls passage of water between the chamber $C_1$ and the region of low pressure L. The ports of the valve means $V_2$ connected to the conduits 14 and 16 together with the ball $V_2B$ provide the other valve of the second pair of valves which controls passage of water between the chamber $C_2$ and the low pressure region.

In use, with the piston 8 in the full line position shown in FIG. 1 and the valve means $V_1$ and $V_2$ in position A, and assuming water previously has entered chamber $C_2$ from reservoir 11, then when the piston 8 is moved to the right, by water entering chamber $C_1$ from the high pressure region H via valve means $V_1$, the water, from the low pressure region L, in the chamber $C_2$ is displaced via valve means $V_2$ into the high pressure region. Then when the piston returns to the left, after rotation of the balls of the valve means $V_1$ and $V_2$, by water entering chamber $C_2$ from the low pressure region L, the water, from the high pressure region H, in the chamber $C_1$ is displaced via valve means $V_1$ into the low pressure region. This cycle is then repeated.

The reservoir 11 is provided with a float controlled switch 18 which operates a motor 19 which drives a small flow, high pressure, pump 20 to collect any excess water which accumulates in the reservoir 11 as a result of small leaks and due to compressibility effects, and expels it via conduits 22 and 23, non-return valve 21, conduit 24, conduit 15 and non-return valve 17 to the high pressure region H. As soon as the level of the water in the reservoir 11 falls to a desired value, the flow control switch 18 opens and operation of the pump 20 stops and the valve 21 closes.

The shaft 25 is rotated as a result of reciprocation of the rack 27 caused by differential area piston 29, 30 sliding in a cylinder 28 with suitable sliding seals. Oil is fed from an oil reservoir 33 via conduit 35 by a pump 32, driven by a motor 31, which discharges high pressure oil to a conduit 36 at a pressure level set by pressure control means indicated at 34. For example a pressure release valve. The high pressure oil in the conduit 36 is fed to act on the smaller area side of the differential area piston 29, 30 whilst the larger area of the piston is fed from the centre point of two solenoid operated valves $SOL_1$ and $SOL_2$ so that when $SOL_1$ is open and $SOL_2$ is closed, the larger area of the piston is exposed to full pressure and the piston moves valve means $V_1$ and $V_2$ to position A.

When $SOL_1$ is closed and $SOL_2$ is open, the larger area of the piston is at low pressure and the piston moves the rack to rotate the balls of the valve means $V_1$ and $V_2$ to position D.

The piston 8 carries a magnet M to operate reed switches $MS_1$ and $MS_2$ located outside the vessel 7, the vessel 7 being made of non-magnetic material.

Figure 2:
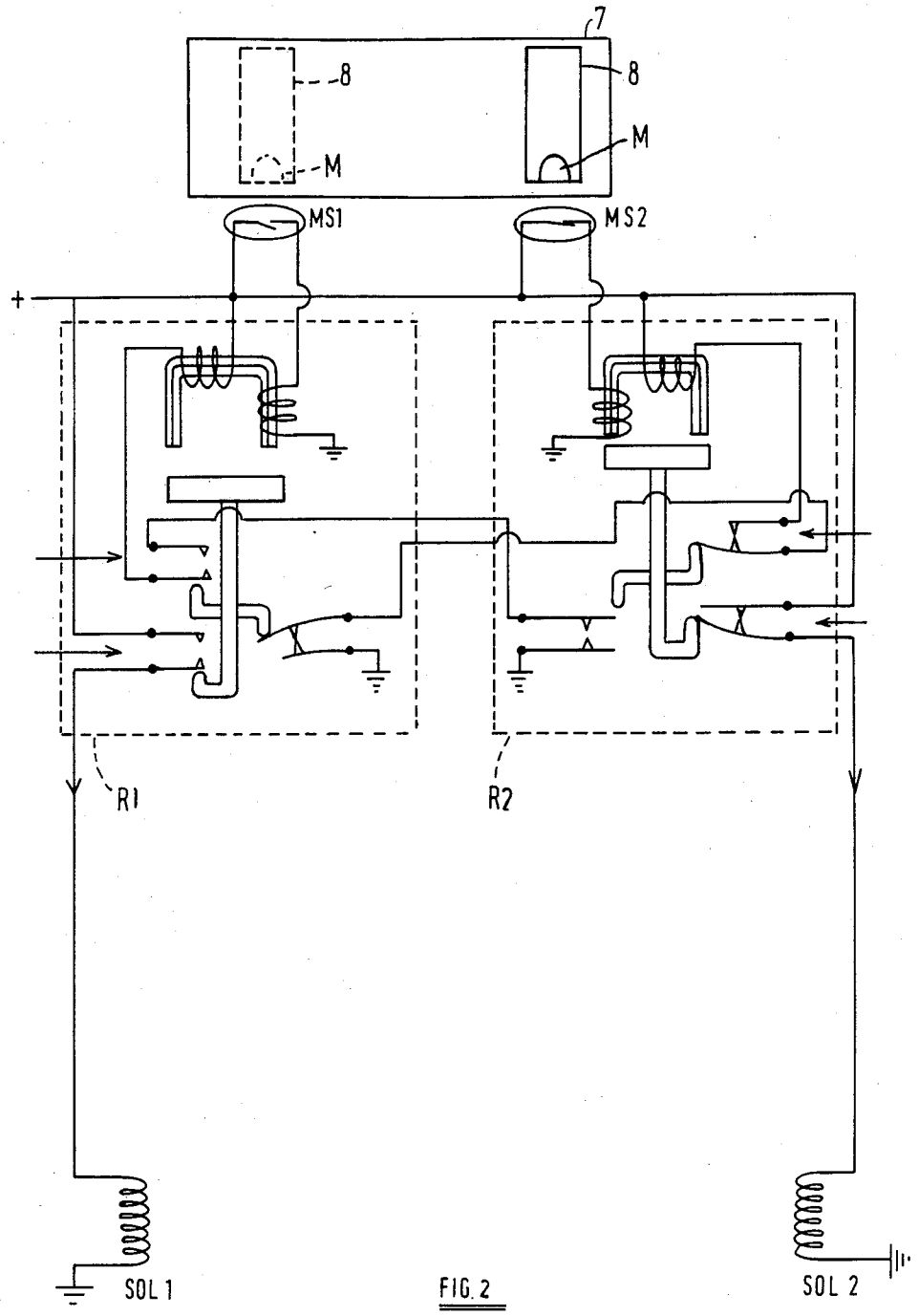
FIG. 2 is an electrical circuit diagram of the embodiment of Figure 1.

Thus, when the piston 8 has moved fully or nearly fully to the right in FIG. 1, with valve means $V_1$ and $V_2$ in position A, i.e. with high pressure acting on the larger area of the differential area piston 29, 30, the magnet M causes an electrical contact to be made by reed switch $MS_2$ to product current flow to a double-wound relay $R_2$ with multiple contacts of known type, see FIG. 2.

When the contacts $MS_2$ are closed by the magnet M, the current energises relay $R_2$ which:

(a) cancels the engagement of the relay $R_1$ and so interrupts the electrical supply to solenoid valve $SOL_1$;

(b) operates a "hold-on" through the secondary winding of the relay $R_2$ which is brought into operation with the cancelling of $R_1$;

(c) provides an electrical supply to solenoid valve $SOL_2$.

Both $SOL_1$ and $SOL_2$ valves are closed when not energised, both open when both are energised. Thus the output of relay $R_2$ which arises as soon as the piston has moved fully to the right is arranged to open $SOL_2$, and the cancelling of the output of relay $R_1$, which also arose from the same sequence, cuts off electrical supply to solenoid valve $SOL_1$ which thus closes. As a result the pressure on the larger area of the differential piston 29, 30 reduces thereby moving the rack 27, piston 26 and shaft 25 trough an angle of 300° (during part of which angle all ports of both valve means $V_1$ and $V_2$ are closed). The result is that both valve means $V_1$ and $V_2$ are moved to position D, arrest of movement of the valve means $V_1$ and $V_2$ in position D being arranged by, for example, mechanical stops on the differential piston travel or by any other suitable means.

The pump 13 now causes piston 8 to move from right to left until the piston has moved fully, or nearly fully, to the left and the piston magnet M operates reed switch $MS_1$ which energises relay $R_1$ which:

(a) cancels the "hold-on" of relay $R_2$ and so interrupts the electrical supply to solenoid valve $SOL_2$;

(b) operates its own "hold-on";

(c) provides an electrical supply to solenoid valve $SOL_1$.

As a result, solenoid valve $SOL_1$ opens and solenoid valve $SOL_2$ closes and the pressure acting on the larger diameter part of the differential piston 29, 30 increases to full pressure. As a result the piston moves the rack 27 and pinion 26 and hence rotates shaft 25 to move valve means $V_1$ and $V_2$ from position D to position A whereupon the cycle is repeated.

The arrangement is that either $R_1$ or $R_2$ is closed and will stay in this condition until the piston travels to the opposite end of its stroke when the relays change to the opposite condition.

It is to be noted that in the event of any failure of electrical power supply to solenoids $SOL_1$ or $SOL_2$, the system fails safe.

The rates of movement of the piston 8 are controlled as follows:

Movement from left to right is controlled by the spring 6 and the pressure exerted by the pump 2 or the ram intake 3.

Movement from right to left is controlled by the pump 13, opposed by spring 6, and pressure drop in the process volume 10 and in the various valves and conduits etc.

Therefore the net rates of flow and speed of cycling are controlled primarily by the pump 13 and the pump 13 may be controlled as desired.

At low flow rates it may be convenient to incorporate a throttling orifice downstream of the pump 13 to linearise and stabilise the relationship between flow and speed.

In order to commence operation of the apparatus, relay $R_1$, or relay $R_2$ as desired, is engaged by means of a manually operated contact which simulates the operation of magnetic switch $MS_1$ or $MS_2$, preferably $MS_2$ since this is the position most likely to arise after the system has been stopped (i.e. the spring 6 extended). The system may be stopped deliberately in this condition by the manual operation, e.g. push button stop, of a break in the electric circuit from switch $MS_2$ to relay $R_2$.

Because mechanical failure of the valve seals, hereinafter to be described, within the valve means $V_1$ or $V_2$ can allow a large flow of water from the high pressure region H into the process volume 10 and the reservoir 11 such that the small return pump 20 could not cope, the connections of the process volume 10 and reservoir 11 to apparatus the water is intended to be used in connection with, in the present example inlet and outlet connections for gas, are provided with float valves 40, 41 arranged so that flooding of the process volume 10 and reservoir 11 results in water rising in the float valves which therefore isolate the gas system from flooding independently of the rest of the system.

Referring now particularly to FIGS. 3–6, each of the ball valve means $V_1$, $V_2$ comprises a spherical ball 50 provided with interconnected passages 51, 52, the openings of which at the periphery of the ball are sharp edged. The ball 50 is supported on integral trunnions 58 whose axis passes through the centre of the ball 50 and they are supported on anti-friction bearings 57 so that the ball 50 can rotate without altering the clearance between the spherical surface of the ball and a body 55 within which the ball is rotatably mounted, except, of course for small changes of the order of 0.001 inch.

The body 55 is provided with the hereinbefore mentioned conduits 4, 5 and 9 in the body relating to valve means $V_1$ and conduits 14, 15 and 16 in the body relating to the valve means $V_2$.

At the mouth of the conduits to the spherical opening of the body 55, cylindrical recesses, coaxial with the conduits are provided and in these are located seals 53 which are urged against the spherical surface of the bore by a coil compression spring 56. The seals are made of relatively hard material such as tungsten carbide and the surface of the seals contacting the ball 50 is of the same radius as the ball 50 so that the two components contact each other over an area around the seal perimeter.

The edges of the sealing surface are sharp edged, with their angle approximating to a right angle thereby giving a sharp cutting edge both on the inner and outer edges of the seal. The outer cylindrical surface of the seal has clearance to the cylindrical recess so the seal can be laterally supported by the body against cutting forces which arise if foreign bodies are trapped between the edges of the ball in the bore and the edges of the seal sealing surface.

A ring 54 made of rubber or other suitable elastomeric material or a metal bellows is arranged to allow the sealing ring to move to accommodate changes of the ball valve position as it is rotated, small as they are and still maintain a seal between the sealing ring and the ball.

Since the pressure in the conduit 4 is always above or equal to the "ball to body clearance pressure" the effective area exposed to the pressure in the duct 4 is made larger than the means pressure area of the sealing ring-ball contact area so that a pressure drop will urge the sealing ring harder onto the ball to ensure a good seal. It should be noted that excessive area produces too great a mechanical friction between the sealing ring and the ball when the ball is to be rotated needing a larger power output from the piston 29, 30.

Figure 6:
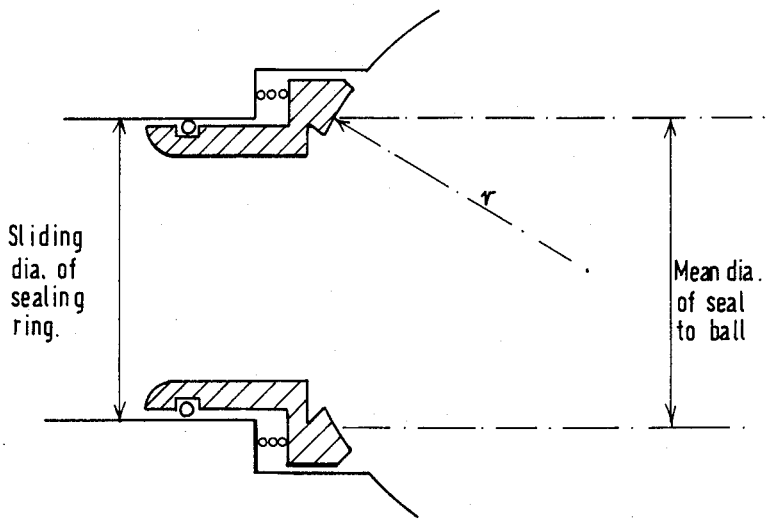
FIG. 6 is a view similar to that of FIG. 5 but showing engagement between the ball valve member and another form of seal.

For conduits 9 and 14 the pressure in the conduit is always lower than the ball-body clearance pressure so the seal ring is pushed onto the ball by a spring but the pressure balance is reversed with bellows or rubber ring effective area less than the sealing ring to ball contact area as shown in FIG. 6.

For the conduits 5 and 16, the mean diameter of the seal ring/ball contact area and that of the sliding rubber seal or effective area of the bellows are made equal and the stronger spring provided.

In the embodiment described hereinbefore, no provision has been made to stop operation of the apparatus if the "seal ring to ball" system loses effectiveness as a watertight seal as might arise if the surfaces were deeply scored by operation, for example as a result of sand being present in the water, or if the seal rings became wedged out of ball contact by some hard material not being cut by the sharp edges, or if the rubber rings or the sealing bellows fail.

Therefore, an apparatus to give warning of these conditions and to prevent further operation which could lead to possibility of out-of-control flooding of the low pressure region is desirable and essential in certain applications. Such an embodiment will now be described with reference to FIGS. 7 and 8. This embodiment is similar to the embodiment described with reference to FIGS. 1–6, and the same reference numerals have been used for corresponding parts. Only the differences between the embodiment illustrated in FIGS. 7 and 8 and that described with reference to FIGS. 1 to 6 will be described. In FIG. 8 the details of the relays $R_1$ and $R_2$ are not illustrated being the same as shown in FIG. 2.

Figure 7:
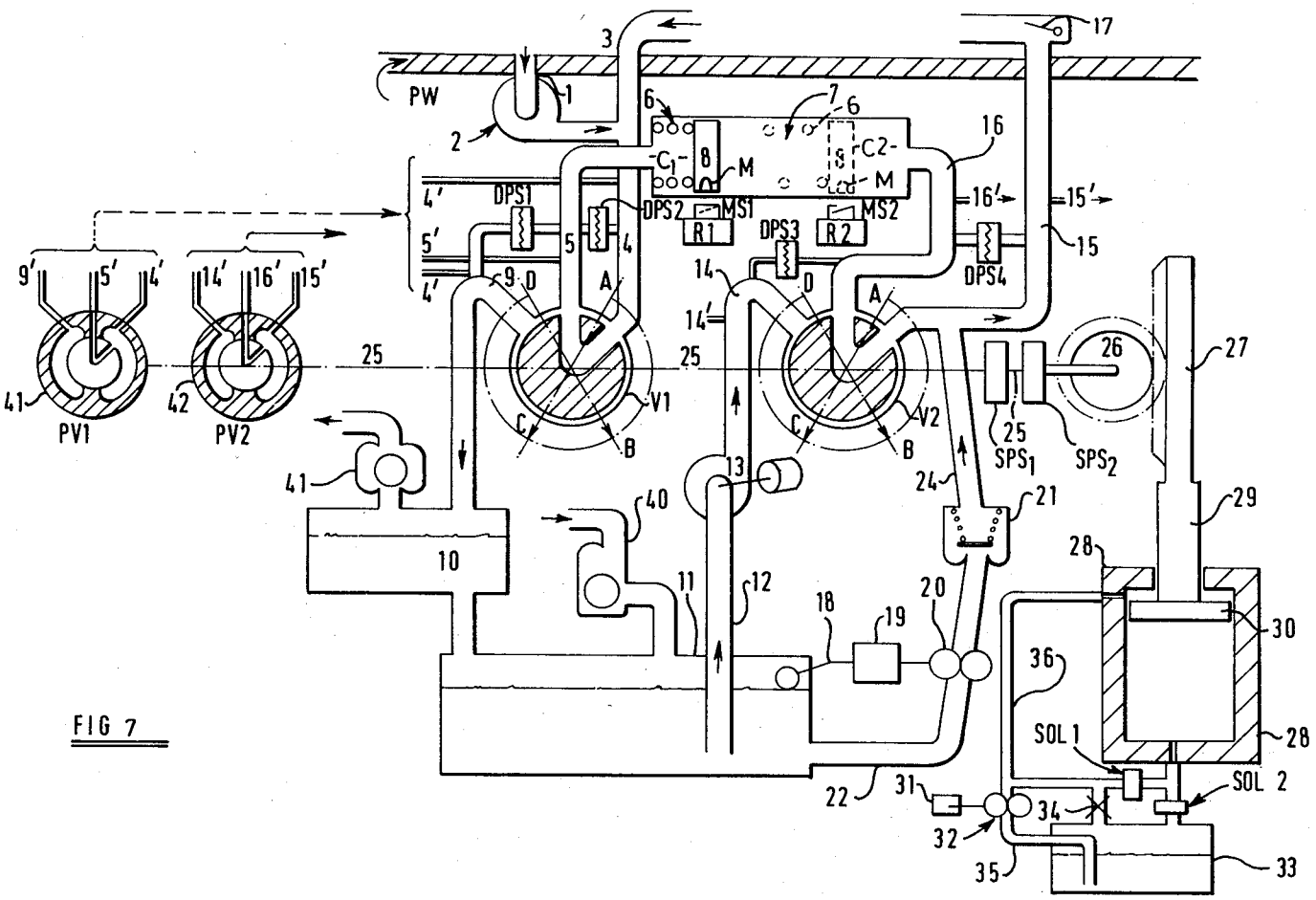
FIG. 7 is a diagrammatic illustration of a second embodiment of the invention.
Figure 8:
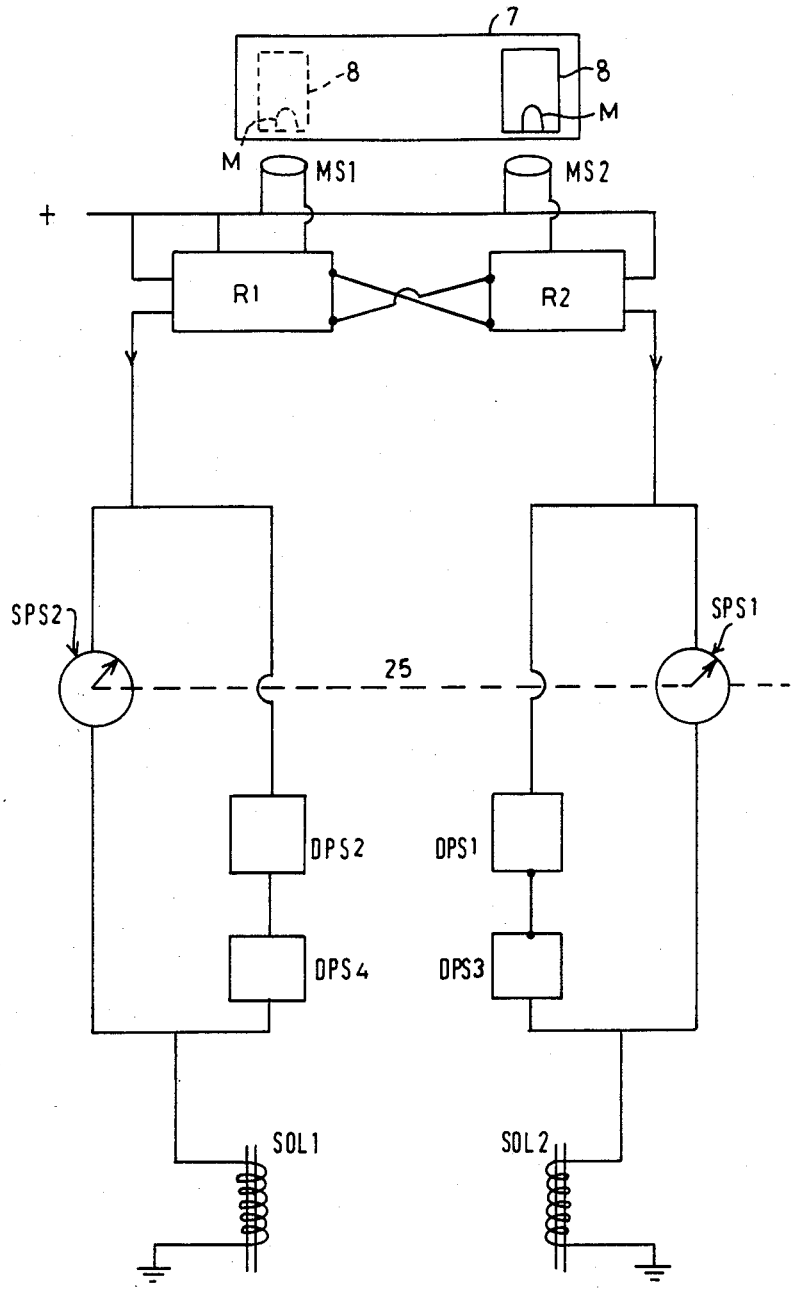
FIG. 8 is an electrical circuit diagram of the embodiment shown in FIG. 7.

The embodiment shown in FIG. 7 is provided with four pressure difference switches (DPS) as follows:

$DPS_1$ between conduits 5 and 9; $DPS_2$ between conduits 5 and 4; $DPS_3$ between conduits 14 and 16 and $DPS_4$ between conduits 16 and 15.

The switches $DPS_1$-$DPS_4$ make electrical contact when the pressure drops are low, for example of the order of 50 p.s.i., and break contact when pressure changes are high, for example 500 p.s.i. or above.

In addition, two pilot valves $PV_1$ and $PV_2$ are provided operated by shaft 25. Each of the pilot valves is relatively small and comprise a cylindrical shaft with two radial bores rotatable within a valve body 41, 42 provided with radial passages communicating with conduits 4', 5', 9' in the case of the body 41 of the valve $PV_1$ and 14', 16', 15' in the case of the body 42 of the valve $PV_2$. The bores are about 1/20th the diameter of the bores of the main flow valve means $V_1$, $V_2$ and such valves can be made with fine clearances of small diameters so that sealing is not a major consideration as it is with $V_1$ and $V_2$. Although cylindrical type valves have been described above and are illustrated, face type valves or piston type valves may be used alternatively since they can be largely protected against dirt by self-cleaning filters.

The embodiment shown in FIG. 7 is also provided with angular shaft position switches $SPS_1$ and $SPS_2$ provided on the shaft 25 at a convenient location which operate contacts when the shaft 25 occupies intermediate positions between the normal operating positions A and D, which positions are called B and C.

The shaft 25 rotates through these positions on every valve changeover and change of piston direction. Typically B is 120° from A whilst C is 120° from D with an angle of 60° between B and C.

The contacts of switch $SPS_1$ are open when the shaft rotates from position C to position D, i.e. from 180° from A to 300° from A and its contacts are closed from A to C, i.e. 0° to 180° from A.

The contacts of switch $SPS_2$ are open whilst the shaft rotates from position B to position A, i.e. 120° to 0° from A and are closed whilst the shaft rotates from position D to position B, i.e. 180° from D to 0° from D.

The pilot valve $PV_1$ arranged to connect conduit 5 to conduit 4 between shaft positions 0° to 150° from A and conduit 5 to conduit 9 from shaft positions 150° from A to 300° from A by virtue of conduits 4', 5', and 9' connected between the valve body 41 and the conduits 4, 5, and 9 respectively.

Similarly the pilot valve $PV_2$ is a two-way valve arranged to connect conduits 16 to conduit 15 through shaft angles 0° to 150° from A and to connect conduit 16 to conduit 14 for shaft angles 150° to 300° from A. Again this is similarly achieved by providing ducts 14', 15', 16' which connect the valve body 42 of the valve $PV_2$ to the ducts 14, 15 and 16 respectively.

The electrical connections from relays $R_1$ and $R_2$ which, in the embodiment shown in FIGS. 1 and 2, went directly to solenoid valves $SOL_1$, $SOL_2$ are now diverted. The connection from the relay $R_2$ to solenoid valve $SOL_2$ is, in the embodiment shown in FIGS. 7 and 8, taken through switch $SPS_1$ and to switch $DPS_1$ and $DPS_3$ in series and then solenoid $SOL_2$ thereby giving two routes in parallel from relay $R_2$ to solenoid $SOL_2$.

The connection from relay $R_1$ in the embodiment shown in FIGS. 7 and 8 goes via $SPS_2$ and to $DPS_2$ and $DPS_4$ in series and then to solenoid $SOL_1$ giving two routes in parallel from relay $R_1$ to solenoid $SOL_1$.

Figure 3:
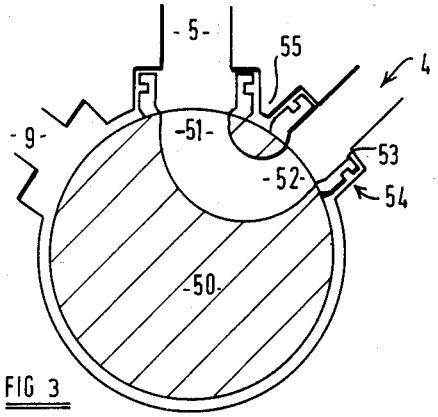
FIG. 3 is a cross-section through a ball valve of the embodiment of FIG. 1.
Figure 4:
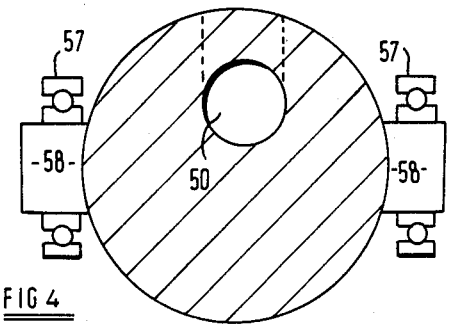
FIG. 4 is a section in a plane at right angles to the plane of Figure 3.
Figure 5:
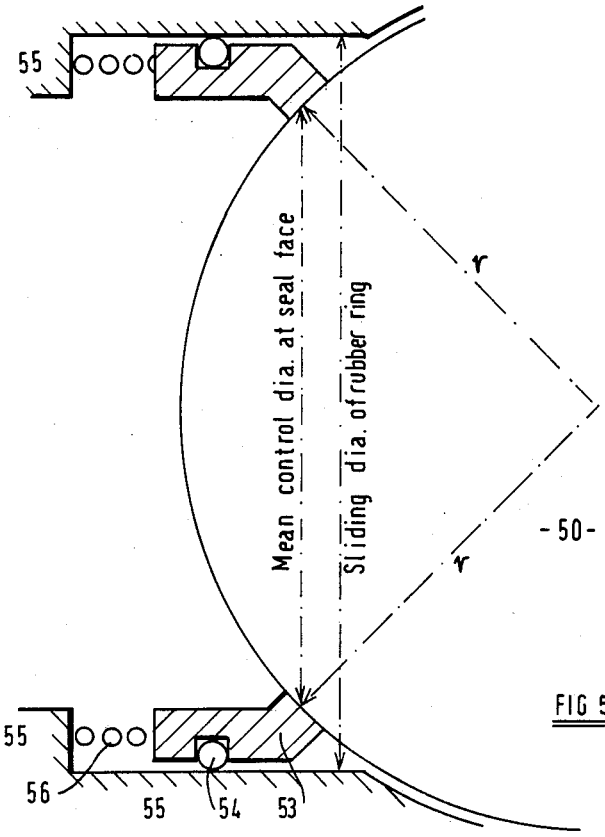
FIG. 5 is a sectional view, to an enlarged scale,showing the engagement between a ball valve member and one form of seal of the valve shown in FIGS. 3 and 4.

In use, when the piston 8 has moved fully to the right in FIG. 3, the magnet M causes contact to be made by switch $MS_2$ and energises relay $R_2$ and de-energises relay $R_1$ as in the embodiment of FIG. 1. The output from relay $R_2$ goes to switch $SPS_1$ and hence directly to $SOL_2$ and the shaft 25 turns to position C whereupon the contacts of switch $SPS_1$ opens and the shaft stops at position C. The same shaft movement connects conduit 5 to conduit 9 via pilot valve $PV_1$. If the seals on conduits 4, 5 and 9 are liquid-tight, a spurt of water goes through the pilot valve, because of high pressure in the first chamber, and the pressure in the duct 5 falls to that in the duct 9. Switch $DPS_1$ then detects the low pressure drop and makes its contact.

Similarly if the seals in valve $V_2$ between ducts 14, 15 and 16 are liquid-tight, the pressure in conduit 16 falls to low pressure, i.e. the pressure obtaining in the conduit 14, and $DPS_3$ detects low pressure drop and hence makes contact.

These two contacts will be made in series for the signal from $R_2$ to continue to $SOL_2$ which continues the shaft rotation from position C to position D and the cycle continues.

Unless all six seals are liquid-tight, switches $DPS_1$ and $DPS_3$ will sense significant pressure drops and will stop the system at position C so no liquid flow can occur.

On reverse operation, relay $R_1$ is operated by reed switch $MS_1$ ($R_2$ is cancelled from "off") and the signal goes via $SPS_2$ and thus to $SOL_1$ causing the shaft to be rotated from position D (300° from A) to B (120° from A) whereupon the contacts of switch $SPS_2$ open and the shaft 25 stops. The pilot valves at this position connect conduit 5 to conduit 4 and conduit 15 to conduit 16 through relatively small holes. If the pressure finally equalises or nearly so, as measured by switches $DPS_2$ and $DPS_4$ signifying that the seals of valves $V_1$ and $V_2$ are liquid-tight, the signal from relay $R_1$ passes through switches $DPS_2$ and $DPS_4$ to solenoid valve $SOL_1$ causing the shaft to rotate from B to A and the cycle continues.

Figure 9:
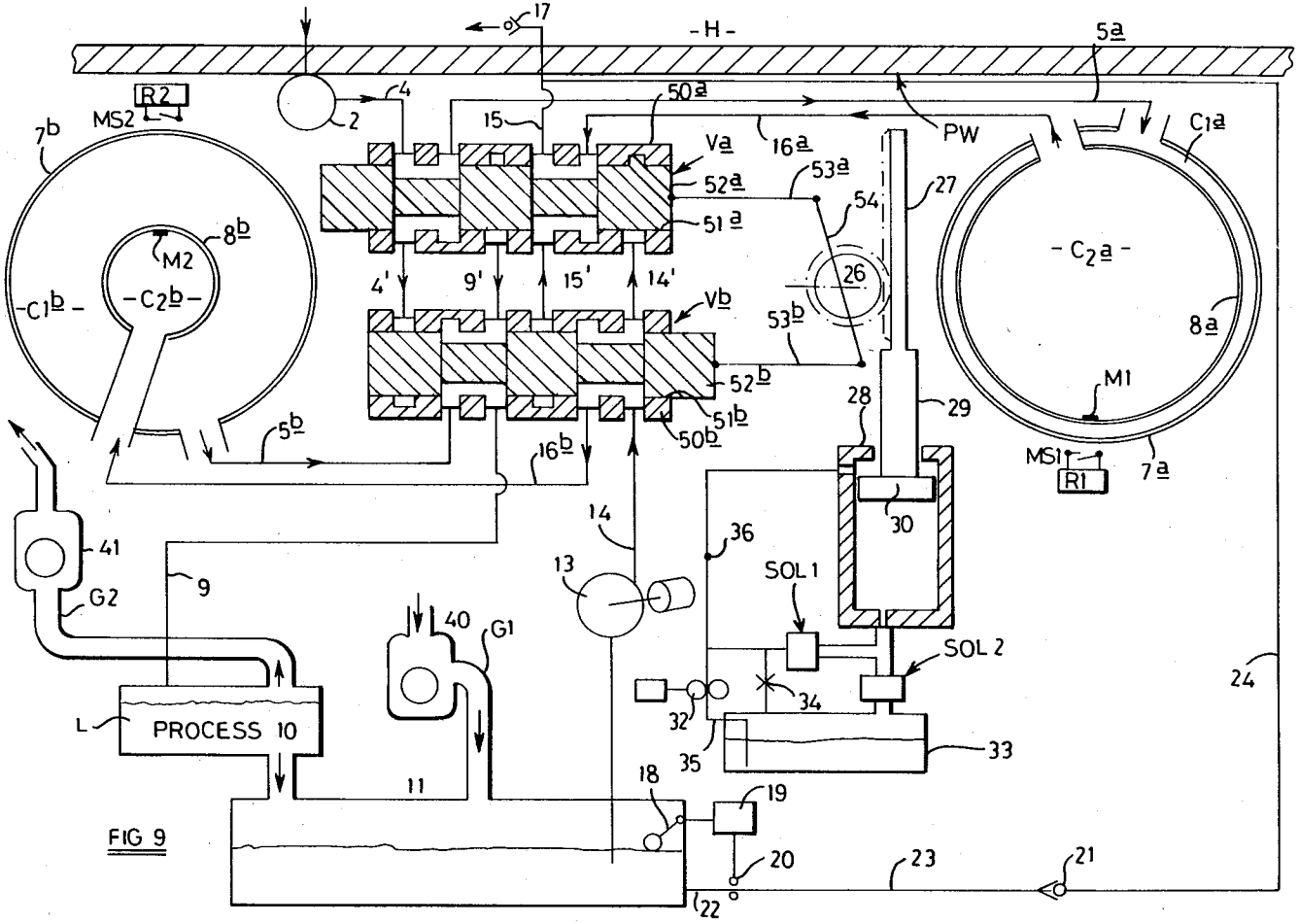
FIG. 9 is a diagrammatic illustration of a third embodiment of the invention, showing one condition of operation.
Figure 10:
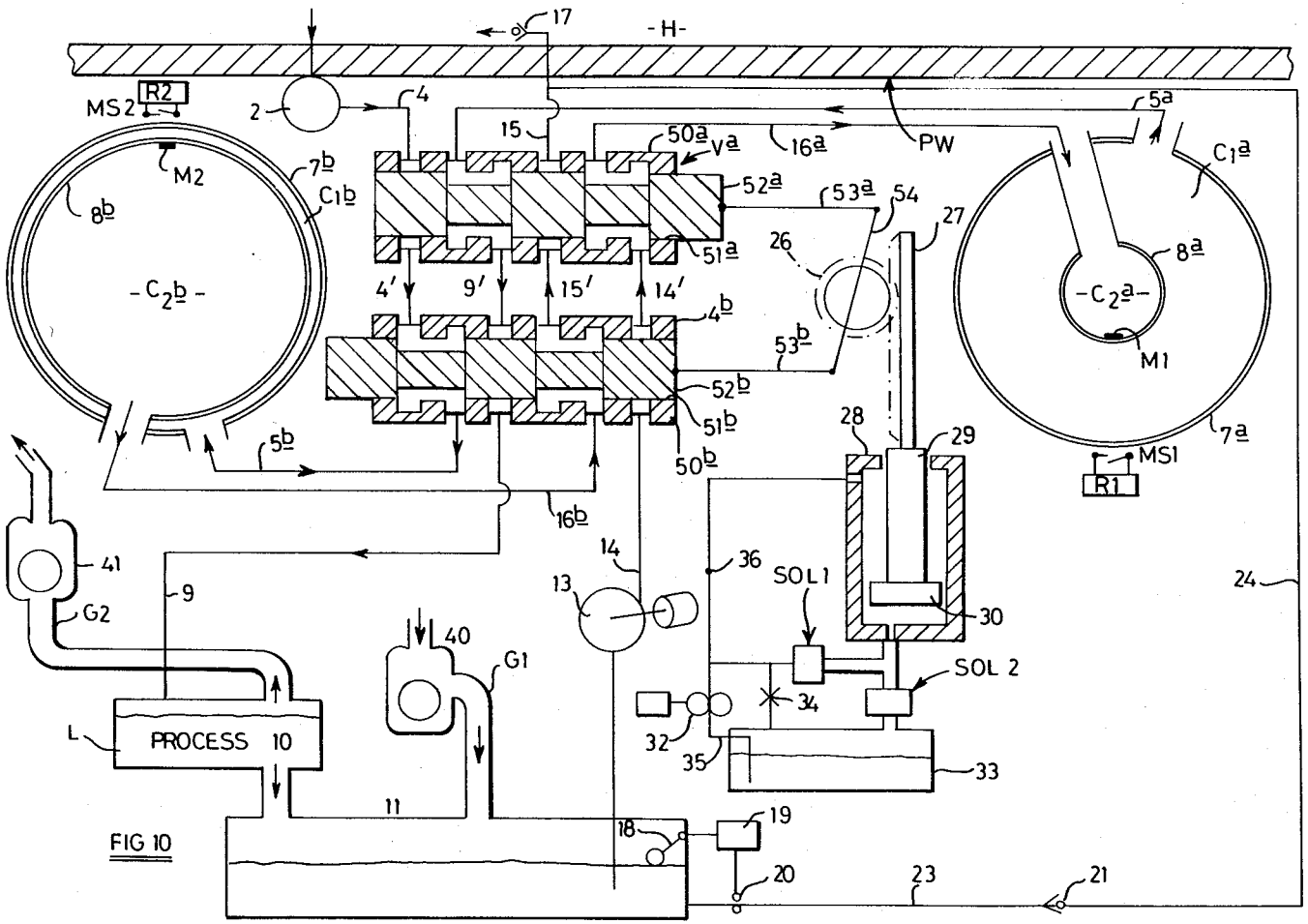
FIG. 10 is a view similar to that of FIG. 9 but showing a different condition of operation of the third embodiment.

A third embodiment of the invention is shown in FIGS. 9 and 10. This embodiment is similar to the first embodiment described with reference to FIGS. 1 to 6 but differs by virtue of having two vessels, shown at **7*a* and 7b in FIGS. 9 and 10 instead of a single vessel 7; by virtue of each chamber comprising a rigid sphere with a flexible generally spherical separator member 8*a*, 8*b* therein instead of a rigid cylindrical vessel and rigid piston 8, and by virtue of having rectilinearly sliding valve means Va, Vb instead of the rotary valve means $V_1$, $V_2$. In other respects the third embodiment is as described with reference to the first embodiment and the same reference numerals have been used in FIGS. 9 and 10 as were used in FIGS. 1 to 6** to refer to correspondingly similar parts.

More particularly, each vessel **7*a*, 7*b* comprises a rigid sphere made of non-magnetic material having disposed therein a flexible dividing member made, for example, of rubber or other suitable deformable material. The dividing member 8*a*, 8*b* divides each vessel 7*a*, 7*b* into a first, outer chamber $C_1a$, $C_1b$ and a second, inner chamber $C_2a$, $C_2b$. The first chamber $C_1a$, $C_1b$ of each vessel 7*a*, 7*b* is connected by a conduit 5*a*, 5*b* to the valve means $V_aV_b$ and each inner or second chamber $C_2a$, $C_2b$ is connected by conduit 16*a*, 16*b*** to the valve means $V_aV_b$.

With the two vessel arrangement of the third embodiment, a more continuous operation can be achieved, in that water can be extracted from and delivered to the high pressure region by one vessel simultaneously with extraction from and delivery to the water to the low pressure region from the other vessel.

Each valve means $V_a$, $V_b$ is essentially similar and comprises a valve body **50*a*, 50*b* having an axial bore 51*a*, 51*b* therein to receive a rectilinearly slidable valve member 52*a*, 52*b* which are caused to reciprocate rectilinearly in opposite directions by means of rods 53*a*, 53*b* connected to opposite ends of a lever 54 caused to rotate by a pinion 26 which meshes with a rack 27 as described in connection with the first embodiment. The valve bodies 50*a*, 50*b* are provided with four ports. The valve body 50*a* having ports connected to conduits 4, 5*a*, 15 and 16*a* and body 50*b* having ports connected to conduits 5*b*, 9, 16*b* and 14. In addition, the valve bodies 50*a*, 50*b* are interconnected by conduits 4', 9', 14', 15'. It will also be noted that the valve bodies 50*a*, 50*b* are provided with annular passages in axial alignment with each port to permit of fluid flow circumferentially around the associated valve members 52*a*, 52*b***.

In this embodiment the ports of the valve means $V_a$ connected to conduits 4 and **5*a* together with the valve member 52*a* provide one valve of a first pair of valves associated with the vessel 7*a* to control passage of water between the chamber $C_1a$ of the one vessel 7*a* and the high pressure region H. The ports of the valve means $V_a$ connected to conduits 15 and 16*a* together with the valve member 52*a*** provide the other valve of the first pair of valves which controls passage of water between the chamber $C_2a$ and the high pressure region H.

The ports of the valve means $V_a$ connected to the conduits **5*a* and 9' which is connected through valve means $V_b$ to conduit 9, together with the valve member 52*a* provide one valve of a second pair of valves which controls passage of water between the chamber $C_1a$ and the region of low pressure L. The ports of the valve means $V_a$ connected to the conduits 16*a* and 14' which is connected through valve means $V_b$ to conduit 14 together with the valve member 52*a*** provide the other valve of the second pair of valves which controls passage of water between the chamber $C_2a$ and the low pressure region L.

Similarly, with regard to the vessel **7*b*, the ports of the valve means $V_b$ connected to the conduits 5*b* and 4' which is connected through valve means $V_a$ to conduit 4 together with valve member 52*b* provides one valve of a first pair of valves, associated with the chamber 7b, which controls passage of water between chamber $C_1b$ and the region of high pressure H. The ports of the valve means $V_b$ connected to conduits 16b and 15' which is connected through valve means $V_a$ to conduit 15, together with valve member 52b, provides the other valve of the first pair of valves which controls passage of water between the chamber $C_2b$ and the region of high pressure H. The ports of the value means $V_b$ connected to the conduits 5b and 9 together with the valve member 52b provide one valve of a second pair of valves which controls passage of water between the chamber $C_1b$ and the region of low pressure L. The ports of the valve means $V_b$ connected to the conduits 16b and 14 together with the valve member 52b** provide the other valve of the second pair of valves which controls passage of water between the chamber $C_2b$ and the low pressure region L.

Although in this example the valve means $V_a$ and $V_b$ have been interconnected by conduits 4', 9', 14' and 15', it will be seen that the valve means $V_a$ has no affect on flow of water between the conduits 4 and 4' and the conduits 15 and 15' whilst the valve means $V_b$ has no affect on the flow of water between the conduits 9 and 9' and 14 and 14'. Hence, if desired, instead of said interconnection, the conduits 4 and 15 could be provided with a branch which bypasses the valve means $V_a$ and extends directly to the ports of the valve means $V_b$ shown connected to the conduits 4', 15' and similarly the conduits 9 and 14 could be provided with a branch which extends directly to the valve means $V_a$ being connected thereto at the ports shown connected to the conduits 9' and 14'. However, the above described inter-connection of the valve means together with the annular passages associated with each port permits of a more compact and convenient valve assembly.

In use, with the valve means $V_a$, $V_b$ in the position shown in FIG. 9, water flows via conduit 4 from high pressure region H via valve means $V_a$ into conduit 5a and hence into chamber $C_1a$ of vessel 7a to cause contraction of the dividing member 8a and thus expulsion of water already in chamber $C_2a$ (which has been delivered thereinto previously from the low pressure region L) via conduit 16a and valve means $V_a$ and conduit 15 into the high pressure region H. At the same time water is pumped by pump 13 from low pressure region L via conduit 14, valve means $V_b$ and conduit 16b into chamber $C_2b$ of vessel 7b resulting in expansion of the dividing member 8b and thus expulsion of water already in chamber $C_1b$, (which has previously entered $C_1b$ from the region of high pressure) via conduit 5b, valve means $V_b$ and conduit 9 into the low pressure region L.

As the dividing member 8a of vessel 7a moves inwardly, it takes the magnet $M_1$ away from the reed switch $MS_1$ so that as the magnet $M_2$ is brought close to reed switch $MS_2$ by expansion of the dividing member 8b, the relay R2 is energised to (a) cancel the engagement of relay $R_1$ to interrupt the electrical supply to the solenoid valve $SOL_1$;

(b) operate a "hold-on" through the secondary winding of the relay $R_2$ which is brought into operation with the cancelling of $R_1$;

(c) provide an electrical supply to solenoid valve $SOL_2$ so that solenoid valve $SOL_1$ is closed and solenoid valve $SOL_2$ opened so that the differential piston 29, 39 moves downwardly from the position shown in FIG. 9 to that shown in FIG. 10 so rotating the pinion 26 and moving the valve members 52a and 52b from the position shown in FIG. 9 to that shown in FIG. 10.

Thus, referring now to FIG. 10, water now flows from high pressure region H via conduit 4 through valve means $V_a$ and via conduit 4' and valve means $V_b$ into chamber $C_1b$ through conduit 5b to compress the dividing member 8b therein and so expell the water (which had entered chamber $C_2b$ from the region of low pressure as described above in connection with Figure 9), via conduit 16b, valve means $V_b$, conduit 15', valve means $V_a$ and conduit 15 to enter the region of high pressure H. At the same time water from the low pressure region L is pumped by pump 13 via conduit 14, valve means $V_b$, conduit 14', valve means $V_a$ into chamber $C_2a$ of vessel 7a to cause the dividing member 8a thereof to expand and to expell water in the chamber $C_1a$, (which previously entered that chamber from the region of high pressure as described above in connection with FIG. 9) via conduit 5a, valve means $V_a$, conduit 9', valve means $V_b$ and conduit 9 into the region of low pressure L. The contraction of the dividing member 8b moves the magnet $M_2$ away from reed switch $MS_2$ and the expansion of dividing member 8a moves magnet $M_1$ towards reed switch $MS_1$ so as to energise the relay $R_1$ to cause a reverse sequence of operation to that described above.

If desired, the ball type valve means $V_1$, $V_2$ of the first and second described embodiments may be replaced by a single rectilinear valve means of the type described at $V_a$, $V_b$ in the third embodiment. It will be appreciated that for the single vessel arrangement of the first two embodiments then the two pairs of valves are provided by a single valve means of the type shown at $V_a$ and $V_b$ in the third embodiment.

If desired, the rectilinear valve means of the third embodiment may be replaced by suitable numbers of ball type valve means of the type described at $V_1$, $V_2$ of the first and second embodiments.

If desired the third embodiment described above may be modified by the provision of pilot valves similar to the pilot valves $PV_1$ and $PV_2$ of the second embodiment and with pressure difference switches corresponding to the pressure difference switches $DPS_1$-$DPS_4$ of the second embodiment together with valve position switches corresponding to the angular shaft position switches $SPS_1$ and $SPS_2$ of the second embodiment. If desired the valve position switches may be actuated as a result of the rectilinear movement of the valve members 52a, 52b or rods 53a, 53b or by angular rotation of the pinion 26 or a shaft associated therewith.

In a further embodiment, not specifically illustrated, three vessels may be provided each having two pairs of valves connected analogously as described above, the valve members whether sliding or rotating being moved in appropriate sequence so that one vessel operates with the valves for the first pressure region open whilst the second is operating with the valves to the second pressure region open and the third is in a "closing valves and opening valves" phase. If desired more than three vessels may be provided, all of which may operate out of phase with each other or which may be grouped via groups which operate in phase but out of phase with the vessels of other groups.

I claim:

1. A method of transferring liquid between regions of first and second pressure comprising the steps of:

operating a first valve operating means to isolate first and second variable volume chambers from one of said regions and then place said chambers in communication with the other of said regions;

operating a first driving means to move a dividing member to cause liquid from said other region to enter into the first variable volume chamber and displacing, from the second variable volume chamber into said other region, liquid which has previously entered the second chamber from said one region;

operating a second valve operating means to isolate the chambers from said other region and then placing the chambers in communication with said one region and then operating a second driving means to move said dividing member to displace, from said first chamber into said one region, liquid which has previously entered said first chamber from said other region and cause liquid from said one region to enter into the second chamber.

2. A method according to claim 1 wherein said one of said regions comprises said region of second pressure which is a low pressure region and said other of said regions comprises said region of first pressure which is a high pressure region.

3. An apparatus for transferring liquid between regions of a first and a second pressure comprising:

a region of said first pressure and a region of said second pressure;

a vessel;

a dividing member in the vessel, the vessel and the dividing member being relatively movable to divide the vessel into separate variable volume chambers;

a first pair of valves;

one of which controls passage of liquid along a conduit between the valve and a first of said chambers and along a conduit between the valve and said region of a first pressure;

the other of which controls passage of liquid along a conduit between the valve and a second of said chambers and along a conduit between the valve and said region of a first pressure;

a second pair of valves;

one of which controls passage of liquid along a conduit between the valve and said first chamber and along a conduit between the valve and said region of a second pressure;

the other of which controls passage of liquid along a conduit between the valve and said second chamber and along a conduit between the valve and said region of a second pressure;

operating means repeatedly to perform the following cycle of operations, and said means comprising;

a first valve operating means to close the valves of one of said pairs and open the valves of the other of said pairs;

a first driving means to then move the dividing member to cause the volume of said first chamber to increase and the volume of said second chamber to decrease;

a second valve operating means to then close the valves of the other of said pairs and open the valves of said one pair; and a second driving means to then move the dividing member to cause the volume of said first chamber to decrease and the volume of said second chamber to increase.

4. An apparatus according to claim 1 wherein the dividing member is caused to move to vary the volume of said chambers by applying a pressure difference in the liquid on opposite sides of the dividing member.

5. An apparatus according to claim 3 wherein pump means are provided to compensate for differential flow arising from compressibility of liquid and/or variation in chamber volume due to differential pressure by pumping excess liquid direct from a region of low pressure to that of high pressure.

6. An apparatus according to claim 3 wherein a pilot valve provides communication between each chamber and the regions of high and low pressure, there being means to sense a pressure difference across the pilot valve in the event of continued flow of liquid through the pilot valve as a result of leakage of the associated valve.

7. An apparatus according to claim 3 wherein a resilient biasing means is provided to act on the dividing member of a vessel so that when the valves to the higher pressure region are opened the resilient biasing means biases the dividing member to discharge liquid to the higher pressure region and to draw liquid from the higher pressure region into the other chamber, and a pump is provided on the lower pressure side to provide a pressure differential which overcomes the effect of the resilient biasing means to cause reverse movement of the dividing member.

8. An apparatus according to claim 3 wherein means are provided to sense the position of the dividing member at or adjacent the ends of its travel to provide a signal to close and open the respective valves.

9. An apparatus according to claim 3 wherein the valves connected to each chamber of a vessel are combined into a single valve assembly having three ports, one port being connected to the associated chamber, one port being connected to said region of first pressure, and one port being connected to said region of second pressure, the valve assembly being operable to interconnect the port connected to the chamber to either one of the other two ports and to close the other of said other two ports.

10. An apparatus according to claim 3 wherein a plurality of vessels are provided, there being a dividing member in each vessel, each vessel and dividing member therein being relatively movable to divide each vessel into separate variable volume chambers, each vessel having a first pair of valves, one valve of each first pair of valves controlling passage of liquid between a first of said chambers of the associated vessel and said region of a first pressure, and the other of each first pair of valves controlling passage of liquid between a second of said chambers of the associated vessel and said region of a first pressure, each vessel also having a second pair of valves, one valve of each second pair of valves controlling passage of liquid between said first chamber of the associated vessel and said region of a second pressure, and the other valve of each second pair of valves controlling passage of liquid between said second chamber of the associated vessel and said region of second pressure, and said operating means being arranged repeatedly to perform said cycle of operations for each vessel.

11. An apparatus according to claim 10 wherein two vessels are provided and the first pair of valves of one vessel are arranged to be open and the second pair of valves of said one vessel are arranged to be closed when the first pair of valves of the other vessel are closed and the second pair of valves of said other vessel are open and vice versa.

12. An apparatus according to claim 3 wherein the valves comprise rectilinearly movable type elements comprising a valve body having ports connected to the associated chamber and to said regions of high and low pressure, and a valve member rectilinearly slidable within a bore in the valve body and operable to interconnect ports.

13. An apparatus according to claim 12 wherein the valves connected to both the chambers of a vessel are combined into a single valve assembly having two sets of three ports, one port of each set being connected to an associated one of the chambers, a second port of each set being connected to the region of first pressure and a third port of each set being connected to the region of second pressure, and the valve member and valve body being relatively rectilinearly movable to interconnect ports connected to the chambers with either of the other ports of the associated set.

14. An apparatus according to claim 13 wherein the apparatus comprises two vessels and a said single valve assembly is provided for each vessel and the valve members of each valve assembly being arranged to move relative to their associated valve member out of phase with each other.

* * * * *